US011459209B2

(12) United States Patent
Zhao

(10) Patent No.: US 11,459,209 B2
(45) Date of Patent: Oct. 4, 2022

(54) LIGHT WEIGHT LOAD BEARING MEMBER FOR ELEVATOR SYSTEM

(71) Applicant: Otis Elevator Company, Farmington, CT (US)

(72) Inventor: Chen Qian Zhao, Newark, DE (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 99 days.

(21) Appl. No.: 15/809,755

(22) Filed: Nov. 10, 2017

(65) Prior Publication Data

US 2019/0144243 A1 May 16, 2019

(51) Int. Cl.
*D06M 15/564* (2006.01)
*D06M 15/256* (2006.01)
(Continued)

(52) U.S. Cl.
CPC ..... *B66B 11/0065* (2013.01); *B66B 7/062* (2013.01); *D06M 13/152* (2013.01); *D06M 13/352* (2013.01); *D06M 15/256* (2013.01); *D06M 15/564* (2013.01); *D07B 1/025* (2013.01); *D07B 1/04* (2013.01); *D07B 1/162* (2013.01); *D07B 1/165* (2013.01); *D06M 2101/32* (2013.01); *D07B 2201/104* (2013.01); *D07B 2201/1096* (2013.01);
(Continued)

(58) Field of Classification Search
CPC ..... B66B 11/0065; B66B 7/062; D07B 5/00; F16G 11/042
See application file for complete search history.

(56) References Cited

U.S. PATENT DOCUMENTS 4,034,138 A 7/1977 Babayan
6,164,053 A 12/2000 O'Donnell et al.
(Continued)

FOREIGN PATENT DOCUMENTS

CN 105088839 A 11/2015
EP 2067893 B1 6/2009
(Continued)

OTHER PUBLICATIONS

Atkins&Pearce, "High Performance Fibers", Accessed Online: Nov. 10, 2017, 4 Pages, Covington, KY. URL: http://www.atkinsandpearce.com/manufacturing-solutions/fibers/available-fibers/high-performance-fibers/.

(Continued)

*Primary Examiner* — Minh Truong
(74) *Attorney, Agent, or Firm* — Cantor Colburn LLP

(57) ABSTRACT

A lifting member for an elevator system includes a rope formed from plurality of load carrying fibers extending along a length of the lifting member. The plurality of load carrying fibers including a plurality of aromatic polyester based fibers. A coating layer at least partially encapsulates the rope. An elevator system includes a hoistway, an elevator car disposed in the hoistway and movable therein, and a lifting member operably connected to the elevator car to suspend and/or drive the elevator car along the hoistway. The lifting member includes a rope formed from plurality of load carrying fibers extending along a length of the lifting member. The plurality of load carrying fibers including a plurality of aromatic polyester based fibers. A coating layer at least partially encapsulates the rope.

14 Claims, 2 Drawing Sheets

(51) Int. Cl.

| | |
|---|---|
| ***D07B 1/02*** | (2006.01) |
| ***D07B 1/04*** | (2006.01) |
| ***B66B 7/06*** | (2006.01) |
| ***B66B 11/00*** | (2006.01) |
| ***D06M 13/152*** | (2006.01) |
| ***D06M 13/352*** | (2006.01) |
| ***D07B 1/16*** | (2006.01) |
| *D06M 101/32* | (2006.01) |

(52) U.S. Cl.

CPC ..... *D07B 2201/2009* (2013.01); *D07B 2201/2012* (2013.01); *D07B 2201/2036* (2013.01); *D07B 2201/2041* (2013.01); *D07B 2201/2057* (2013.01); *D07B 2201/2065* (2013.01); *D07B 2201/2066* (2013.01); *D07B 2201/2087* (2013.01); *D07B 2201/2092* (2013.01); *D07B 2205/2042* (2013.01); *D07B 2501/2007* (2013.01)

(56) References Cited

U.S. PATENT DOCUMENTS

| | | | | |
|---|---|---|---|---|
| 6,247,359 | B1 * | 6/2001 | De Angelis | D07B 1/14 73/158 |
| 6,397,574 | B1 * | 6/2002 | De Angelis | D07B 1/025 57/251 |
| 6,945,153 | B2 | 9/2005 | Knudsen et al. | |
| 7,137,483 | B2 | 11/2006 | Kato et al. | |
| 9,126,805 | B2 | 9/2015 | Pelto-Huikko et al. | |
| 9,708,758 | B2 | 7/2017 | Amils et al. | |
| 2011/0259677 | A1 | 10/2011 | Dudde et al. | |
| 2013/0338261 | A1 * | 12/2013 | Center | C08K 5/175 523/351 |
| 2014/0087207 | A1 * | 3/2014 | Zhao | B32B 27/08 428/623 |
| 2014/0100097 | A1 * | 4/2014 | Takano | F16C 13/00 492/56 |
| 2014/0305744 | A1 | 10/2014 | Kere et al. | |
| 2014/0345978 | A1 | 11/2014 | Alasentie et al. | |
| 2015/0113936 | A1 * | 4/2015 | Amils | F16G 11/042 57/216 |
| 2015/0354136 | A1 | 12/2015 | Padilla et al. | |
| 2016/0251785 | A1 | 9/2016 | Clough | |
| 2017/0328001 | A1 * | 11/2017 | Kirth | D07B 1/025 |

FOREIGN PATENT DOCUMENTS

| | | | |
|---|---|---|---|
| EP | 2484622 | A1 | 8/2012 |
| EP | 2578527 | A1 | 4/2013 |
| EP | 2361212 | B1 | 2/2014 |
| EP | 2749519 | A1 | 7/2014 |
| EP | 3403977 | A1 | 11/2018 |
| WO | 2004020732 | | 3/2004 |
| WO | 2006057641 | A2 | 6/2006 |
| WO | 2007050069 | A1 | 5/2007 |
| WO | 2010072690 | A1 | 7/2010 |
| WO | 2020072690 | A1 | 7/2010 |
| WO | 2011112322 | A2 | 9/2011 |
| WO | 2017048799 | A1 | 3/2017 |

OTHER PUBLICATIONS

Phillystran, "Phillystran Torque Balanced Ropes—Vectran® (Liquid Crystal Polymer) Rope", Accessed Online: Nov. 10, 2017, 1 Page, Montgomeryville, PA. URL: http://phillystran.com/product-catalog/Torque-Balanced-Ropes-Vectran.

Swicofil, "Vectran Fiber A Unique Combination of Properties for the Most Demanding Applications", Accessed Online: Nov. 10, 2017, 4 Pages. Emmenbrucke, Switzerland. URL: http://www.swicofil.com/vectran.html.

European Search Report Issued In EP Application No. 18205442.9, dated Apr. 12, 2019, 14 Pages.

European Search Report Issued in EP Application No. 18205442.9, dated Aug. 12, 2019, 17 Pages.

Chinese Office Action for Chinese Application No. 201811330869.7, dated Mar. 19, 2020, 13 pages.

* cited by examiner

LIGHT WEIGHT LOAD BEARING MEMBER FOR ELEVATOR SYSTEM

BACKGROUND

Embodiments disclosed herein relate to lifting systems such as elevator systems, and more particularly to load bearing members to suspend and/or drive elevator cars of lifting systems.

Lifting systems, such as elevator systems are useful for carrying passengers, cargo, or both, between various levels in a building. Some elevators are traction based and utilize load bearing members such as belt, ropes or cables for supporting the elevator car and achieving the desired movement and positioning of the elevator car.

Some systems utilize metal ropes as load bearing member, but for high rise lifting such metal ropes are heavy and large in cross-section in related to their tensile strength and stiffness. Similarly, coated steel belts, which are typically steel cords enclosed in a jacket, are also at times too heavy for high rise elevator use, due to the steel cords. Carbon fiber belts, utilizing composite tension elements in the load bearing member will provide improved strength to weight advantages compared to steel cord belt. Such belts, however, require a relatively rigid thermoset matrix to protect fragile carbon fiber. The matrix material reduces flexibility of the belt requiring larger diameter sheaves to be utilized.

BRIEF DESCRIPTION

In one embodiment, a lifting member for an elevator system includes a rope formed from plurality of load carrying fibers extending along a length of the lifting member. The plurality of load carrying fibers include a plurality of aromatic polyester based fibers. A coating layer at least partially encapsulates the rope.

Additionally or alternatively, in this or other embodiments the aromatic polyester fibers are formed from a liquid crystal polymer material.

Additionally or alternatively, in this or other embodiments the plurality of load carrying fibers includes at least 50% aromatic polyester fibers.

Additionally or alternatively, in this or other embodiments the plurality of load carrying fibers further includes one or more of carbon fibers, glass fibers, ultrahigh molecular weight polyethylene fibers, ultrahigh molecular weight polypropylene, polybenzoxazole fibers or nylon fibers.

Additionally or alternatively, in this or other embodiments the coating layer includes a UV stabilizer material.

Additionally or alternatively, in this or other embodiments the UV stabilizer material includes 2-(2H-benzotriazol-2-yl)-4 or 6-ditertpentylphenol.

Additionally or alternatively, in this or other embodiments the coating layer includes an aliphatic based polyurethane dispersion.

Additionally or alternatively, in this or other embodiments the aliphatic based polyurethane dispersion is isophorone diisocyanate (IPDI) or tetramethylxylene diisocyanate (TMXDI).

Additionally or alternatively, in this or other embodiments the coating layer is a fluoropolymer dispersion.

Additionally or alternatively, in this or other embodiments the fluoropolymer dispersion is one of polyvinylidene fluoride (PVDF) or ethylene chlorotrifluoroethylene (ECTFE) or mixtures thereof with one or more of an acrylic polymer emulsion, a polyamide dispersion, or a polyurethane dispersion.

Additionally or alternatively, in this or other embodiments the rope includes a plurality of strands each formed from a plurality of load carrying fibers, the plurality of strands formed into the rope by one or more of braiding twisting or winding.

In another embodiment, an elevator system includes a hoistway, an elevator car located in the hoistway and movable therein, and a lifting member operably connected to the elevator car to suspend and/or drive the elevator car along the hoistway. The lifting member includes a rope formed from plurality of load carrying fibers extending along a length of the lifting member. The plurality of load carrying fibers include a plurality of aromatic polyester based fibers. A coating layer at least partially encapsulates the rope.

Additionally or alternatively, in this or other embodiments the aromatic polyester fibers are formed from a liquid crystal polymer material.

Additionally or alternatively, in this or other embodiments the plurality of load carrying fibers includes at least 50% aromatic polyester fibers.

Additionally or alternatively, in this or other embodiments the plurality of load carrying fibers further includes one or more of carbon fibers, glass fibers, ultrahigh molecular weight polyethylene fibers, ultrahigh molecular weight polypropylene, polybenzoxazole fibers or nylon fibers.

Additionally or alternatively, in this or other embodiments the coating layer includes a UV stabilizer material.

Additionally or alternatively, in this or other embodiments the UV stabilizer material includes 2-(2H-benzotriazol-2-yl)-4 or 6-ditertpentylphenol.

Additionally or alternatively, in this or other embodiments the coating layer includes an aliphatic based polyurethane dispersion.

Additionally or alternatively, in this or other embodiments the aliphatic based polyurethane dispersion is isophorone diisocyanate (IPDI) or tetrarnethyixylene diisocyanate (TMXDI).

Additionally or alternatively, in this or other embodiments the coating layer includes one or more of polyvinylidene fluoride (PVDF) or ethylene chlorotrifluoroethylene (ECTFE), or mixtures thereof with one or more of an acrylic polymer emulsion, a polyamide dispersion, or a polyurethane dispersion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
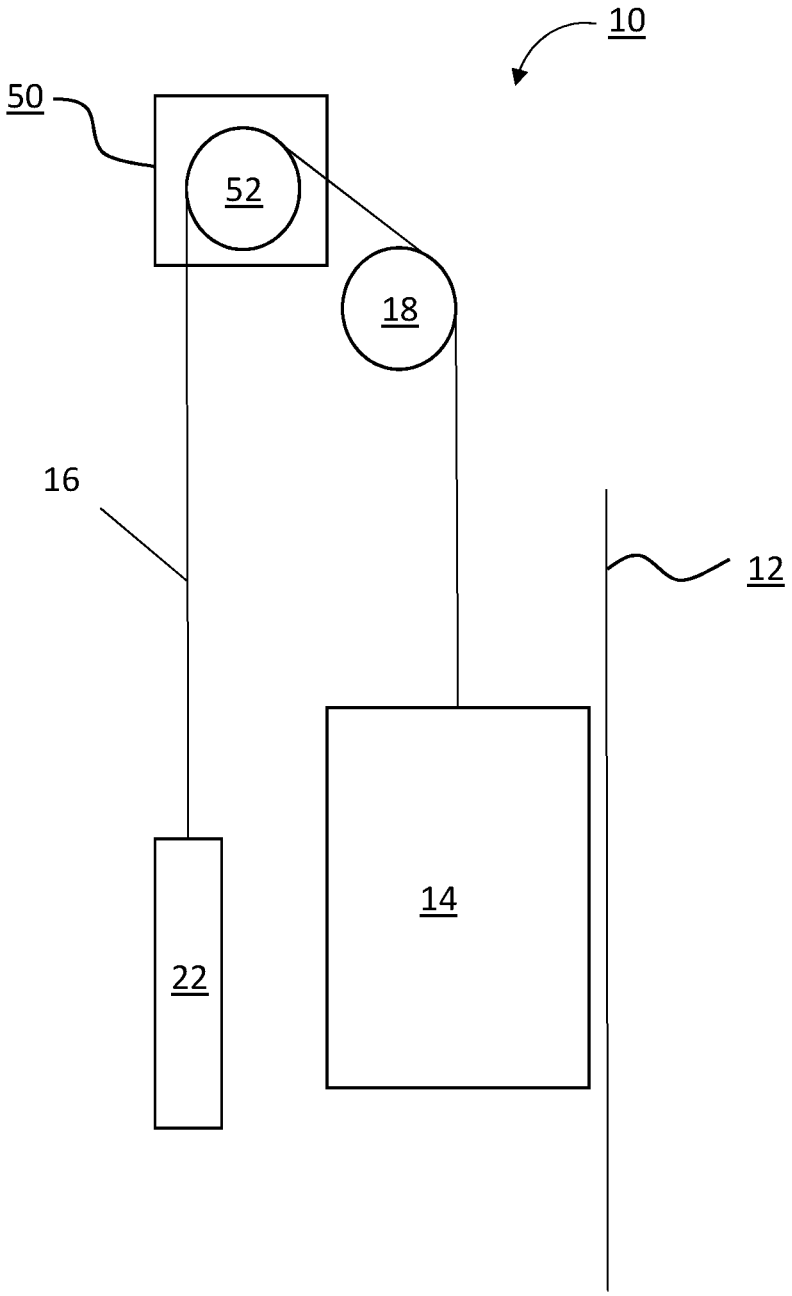
FIG. 1 is a schematic illustration of an embodiment of an elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended or supported in a hoistway 12 with one or more load bearing members, such as ropes 16 or cables.

The one or more ropes 16 interact with sheaves 18 and 52 to be routed around various components of the elevator system 10. Sheave 18 is configured as a diverter, deflector or idler sheave and sheave 52 is configured as a traction sheave 52, driven by a machine 50. Movement of the traction sheave 52 by the machine 50 drives, moves and/or propels (through traction) the one or more ropes 16 that are routed around the traction sheave 52. Diverter, deflector or idler sheaves 18 are not driven by a machine 50, but help guide the one or more ropes 16 around the various components of the elevator system 10. The one or more ropes 16 could also be connected to a counterweight 22, which is used to help balance the elevator system 10 and reduce the difference in rope tension on both sides of the traction sheave during operation. The sheaves 18 and 52 each have a diameter, which may be the same or different from each other.

In some embodiments, the elevator system 10 could use two or more ropes 16 for suspending and/or driving the elevator car 14 In addition, the elevator system 10 could have various configurations such that either both sides of the one or more ropes 16 engage the sheaves 18, 52 or only one side of the one or more ropes 16 engages the sheaves 18, 52. The embodiment of FIG. 1 shows a 1:1 roping arrangement in which the one or more ropes 16 terminate at the car 14 and counterweight 22, while other embodiments may utilize other roping arrangements.

The ropes 16 are constructed to meet rope life requirements and have smooth operation, while being sufficiently strong to be capable of meeting strength requirements for suspending and/or driving the elevator car 14 and counterweight 22.

Figure 2:
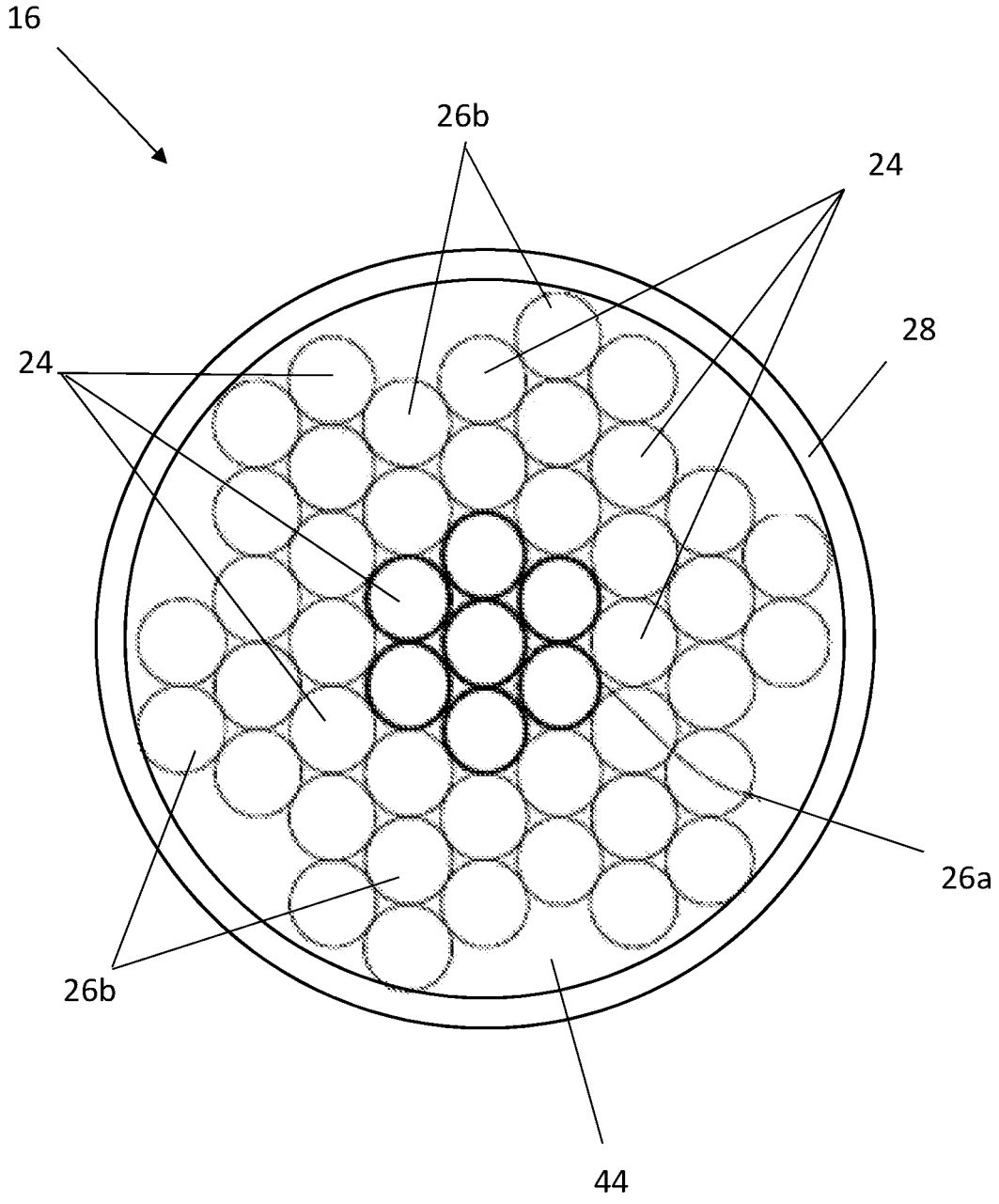
FIG. 2 is a cross-sectional view of an embodiment of a lifting member for an elevator system.

FIG. 2 provides a cross-sectional schematic of an exemplary rope 16 construction or design. The rope 16 comprises a plurality of load carrying fibers 24, braided, twisted, wound or otherwise formed into the rope 16. In some embodiments, the plurality of load carrying fibers 24 are formed into one or more strands 26, which are formed into the rope 16. In some embodiment, such as shown in FIG. 2, the strands 26 are of a substantially identical construction, while in other embodiments, the construction of the strands 26 may be varied. For example, a center strand 26*a* may have a different construction than an outer strand 26*b*.

The plurality of load carrying fibers 24 includes one or more of braided impact resistant liquid crystal polymer and/or carbon fibers and/or glass fibers and/or ultrahigh molecular weight polyethylene fiber and/or ultrahigh molecular weight polypropylene and/or polybenzoxazole fiber and/or nylon. Liquid crystal polymer is an aromatic polyester produced by polycondensation of 4-hydroxybenzoic acid and 6-hydroxynaphthalene-2-carboxylic acid. In some embodiments the liquid crystal polymer is a Vectran™ material. The liquid crystal polymer has a lower density than a typical carbon fiber, about 1.4 g/cm$^3$. Further the tensile strength of liquid crystal polymer is higher than that of typical carbon fiber profile, at about 3000-3200 Megapascals. In some embodiments, the rope 16 includes the liquid crystal polymer and one or more of carbon fibers, glass fibers, ultrahigh molecular weight polyethylene, ultrahigh molecular weight polypropylene, polybenzoxazole fiber or nylon. Further, in some embodiments at least 50% of the load carrying fibers 24 in the rope 16 are aromatic polyester based fibers, such as the liquid crystal polymer.

In some embodiments, the load carrying fibers 24 are disposed in a matrix material 44. The matrix material 44 may be formed from, for example, a polyurethane, vinylester, and epoxy for example. The matrix material 44 is selected to achieve a desired stiffness and strength of the rope 16 in combination with the load carrying fibers 24. While in the embodiment of FIG. 2, a matrix material 44 is illustrated, in some embodiments the matrix material 44 is omitted and the rope 16 is formed as a so-called "dry fiber" configuration.

The rope 16 may be formed as thin layers, in some embodiments by a pultrusion process. In a standard pultrusion process, the first load carrying fibers 24 are impregnated with the matrix material 44 and are pulled through a heated die and additional curing heaters where the matrix material 44 undergoes cross linking. In an exemplary embodiment, the rope 16 has a cross-sectional thickness of about 0.5 millimeters to about 4 millimeters. In another embodiment, the rope 16 has a cross-sectional thickness of 1 millimeter. Further, in some embodiments such as shown in FIG. 2, the rope 16 has a circular cross-section, while in other embodiments the rope 16 may have other cross-sectional shapes, such as rectangular, oval or elliptical.

A coating layer 28 is applied to the rope 16 over the plurality of fibers 24, including a UV stabilizer, to prevent degradation and wear of the rope 16. In some embodiments, the coating material is an aliphatic based polyurethane dispersion, such as Isophorone diisocyanate (IPDI) or tetratriethylxylene diisocyanate (TMXDI), or the like.

UV stabilizer materials in the coating layer 28 may include, but are not limited to 2-(2H-benzotriazol-2-yl)-4, 6-ditertpentylphenol, or the like. Further, the coating layer 28 may include one or more of polyester and polyamide based dispersions, such as 8-20 carbon based monomers for better flexibility. For example, sebacic acid (C-10) and ethylene glycol to C12 polyester resin, which has been used widely in industry. Another example, 11-aminoundecanoic acid is prepared industrially from undecylenic acid, which is derived from castor oil. 11-Aminoundecanoic acid is a precursor to Nylon-11, which is used in high-performance applications such as automotive fuel lines, pneumatic air brake tubing, electrical anti-termite cable sheathing, oil and gas flexible pipes and control fluid umbilicals, sports shoes, electronic device components, and catheters. The coating layer 28 may be applied to the rope 16 by, for example, a dip or spray process, or an extrusion process to apply the coating layer 28 to the rope 16.

In some embodiments, the coating material is polymer dispersion based on polyvinylidene fluoride (PVDF) and/or ethylene chlorotrifluoroethylene (ECTFE). Mostly, these fluoropolymer dispersions are mixtures with certain of other polymers, such as acrylic polymer emulsions, polyamide dispersions, or polyurethane dispersions or the like, to improve their adhesion to the fiber. In this case of using fluoropolymer dispersion, use of UV stabilizers can be omitted because of UV resistance of fluoropolymers.

The coating materials can not only applied over rope as layer 28 but also they can be applied to each strand during rope production or further the coating material can applied over each filament during the fiber production.

Use of the aromatic polyester based fibers such as liquid crystal polymers in the rope 16 reduces weight of the rope 16 compared to a steel corded rope. Further, the rope 16 has a greater tensile strength to weight ratio than a comparable steel corded belt or carbon fiber belt, while also having improved flexibility relative to carbon fiber belt constructions. Thus, of the rope 16 enables reduced diameter sheaves 18 to be utilized in the elevator system 10.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A lifting member for an elevator system, comprising:

a rope formed from plurality of load carrying fibers extending along a length of the lifting member, the plurality of load carrying fibers including a plurality of aromatic polyester based fibers, the plurality of load carrying fibers formed into a plurality of strands;

a matrix material encapsulating the plurality of load carrying fibers; and a coating layer surrounding the plurality of load carrying fibers and the matrix material, thereby defining an external surface of the rope;

wherein the rope includes a plurality of strands each formed from some of the load carrying fibers of the plurality of load carrying fibers, the plurality of strands formed into the rope by one or more of braiding twisting or winding, the plurality of strands including a center strand and a plurality of outer strands arranged to surround the center strand;

wherein the plurality of load carrying fibers further includes ultra-high molecular weight polypropylene or polybenzoxazole fibers;

wherein the coating layer includes a UV stabilizer material;

wherein the UV stabilizer material includes 2-(2H-benzotriazol-2-yl)-4 or 6-ditertpentylphenol; and wherein at least 50% of the load carrying fibers in the rope are aromatic polyester fibers.

2. The lifting member of claim 1, wherein the aromatic polyester fibers are formed from a liquid crystal polymer material.

3. The lifting member of claim 1, wherein the plurality of load carrying fibers further includes one or more of carbon fibers or glass fibers.

4. The lifting member of claim 1, wherein the coating layer includes an aliphatic based polyurethane dispersion.

5. The lifting member of claim 4, wherein the aliphatic based polyurethane dispersion is isophorone diisocyanate (IPDI) or tetramethylxylene diisocyanate (TMXDI).

6. The lifting member of claim 1, wherein the coating layer is a fluoropolymer dispersion.

7. The lifting member of claim 6, wherein the fluoropolymer dispersion is one of polyvinylidene fluoride (PVDF) or ethylene chlorotrifluoroethylene (ECTFE) or mixtures thereof with one or more of an acrylic polymer emulsion, a polyamide dispersion, or a polyurethane dispersion.

8. The lifting member of claim 1, wherein the coating layer is applied to each strand of the plurality of strands.

9. An elevator system, comprising:

a hoistway;

an elevator car disposed in the hoistway and movable therein; and a lifting member operably connected to the elevator car to suspend and/or drive the elevator car along the hoistway, the lifting member including:

a rope formed from plurality of load carrying fibers extending along a length of the lifting member, the plurality of load carrying fibers including a plurality of aromatic polyester based fibers;

a matrix material encapsulating the plurality of load carrying fibers; and a coating layer surrounding the plurality of load carrying fibers and the matrix material, thereby defining an external surface of the lifting member;

wherein the rope includes a plurality of strands each formed from some of the load carrying fibers of the plurality of load carrying fibers, the plurality of strands formed into the rope by one or more of braiding twisting or winding, the plurality of strands including a center strand and a plurality of outer strands arranged to surround the center strand;

wherein the plurality of load carrying fibers further includes ultra-high molecular weight polypropylene or polybenzoxazole fibers;

wherein the coating layer includes a UV stabilizer material;

wherein the UV stabilizer material includes 2-(2H-benzotriazol-2-yl)-4 or 6-ditertpentylphenol; and wherein at least 50% of the load carrying fibers in the rope are aromatic polyester fibers.

10. The elevator system of claim 9, wherein the aromatic polyester fibers are formed from a liquid crystal polymer material.

11. The elevator system of claim 9, wherein the plurality of load carrying fibers further includes one or more of carbon fibers or glass fibers.

12. The elevator system of claim 9, wherein the coating layer includes an aliphatic based polyurethane dispersion.

13. The elevator system of claim 12, wherein the aliphatic based polyurethane dispersion is isophorone diisocyanate (IPDI) or tetramethylxylene diisocyanate (TMXDI).

14. The elevator system of claim 9, wherein the coating layer includes one or more of polyvinylidene fluoride (PVDF) or ethylene chlorotrifluoroethylene (ECTFE), or mixtures thereof with one or more of an acrylic polymer emulsion, a polyamide dispersion, or a polyurethane dispersion.

* * * * *